US009433055B2

(12) United States Patent
Esaki et al.

(10) Patent No.: US 9,433,055 B2
(45) Date of Patent: Aug. 30, 2016

(54) LIGHTING DEVICE AND ILLUMINATION APPARATUS INCLUDING SAME

(75) Inventors: Sana Esaki, Ibaraki (JP); Akinori Hiramatu, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 969 days.

(21) Appl. No.: 13/397,965

(22) Filed: Feb. 16, 2012

(65) Prior Publication Data

US 2012/0212143 A1 Aug. 23, 2012

(30) Foreign Application Priority Data

Feb. 22, 2011 (JP) ..... 2011-035907

(51) Int. Cl.
*H05B 37/00* (2006.01)
*H05B 33/08* (2006.01)

(52) U.S. Cl.
CPC ..... *H05B 33/089* (2013.01)

(58) Field of Classification Search
CPC ..... H05B 31/00–31/52; H05B 33/0818; H05B 33/0815; H05B 33/0809; H05B 33/0827
See application file for complete search history.

(56) References Cited

U.S. PATENT DOCUMENTS

2004/0080273 A1* 4/2004 Ito ..... H05B 33/0815 315/77
2006/0087843 A1* 4/2006 Setomoto et al. ..... 362/249
2009/0015759 A1 1/2009 Honbo
2010/0109537 A1 5/2010 Nishino et al.

FOREIGN PATENT DOCUMENTS

CN 2831680 Y 10/2006
CN 101182909 A 5/2008
CN 101340760 A 1/2009
CN 101511142 A 8/2009
CN 101529983 A 9/2009

(Continued)

OTHER PUBLICATIONS

Japanese Office Action issued on Nov. 18, 2014 in corresponding Japanese Application No. 2011-035907 and English summary thereof.

(Continued)

*Primary Examiner* — Sibin Chen
(74) *Attorney, Agent, or Firm* — Bacon & Thomas, PLLC

(57) ABSTRACT

A lighting device includes a lighting unit which controls a current being supplied to a load, in which light emitting modules, each having one or more semiconductor light emitting elements connected in series, are connected in parallel, to be a constant current; a current detector which detects a current flowing through one of the light emitting modules; and an abnormality detector which compares a detected value from the current detector with an upper limit and a lower limit of a predetermined current range to detect an abnormality in the load. The abnormality detector detects the abnormality in the load if the detected value from the current detector is larger than the upper limit or smaller than the lower limit, and if the abnormality in the load is detected, the lighting unit reduces the current being supplied to the load.

7 Claims, 7 Drawing Sheets

(56) References Cited

FOREIGN PATENT DOCUMENTS

| | | | |
|---|---|---|---|
| CN | 201369862 | Y | 12/2009 |
| CN | 101711070 | A | 5/2010 |
| CN | 101711075 | A | 5/2010 |
| CN | 101841962 | A | 9/2010 |
| CN | 101958527 | A | 1/2011 |
| JP | H09-245972 | A | 9/1997 |
| JP | 2004-134147 | | 4/2004 |
| JP | 2006-114279 | A | 4/2006 |
| JP | 2009-21175 | | 1/2009 |
| JP | 3156000 | U | 11/2009 |
| JP | 2010-123273 | A | 6/2010 |

OTHER PUBLICATIONS

Chinese Office Action dated May 6, 2014, issued in corresponding Chinese application No. 201210040755.5 and the English translation thereof.

Chinese Office Action dated Dec. 3, 2013 issued in corresponding Chinese application No. 201210040755.5 and the English translation thereof.

Chinese Office Action issued on Aug. 12, 2014 in a corresponding Chinese Application No. 201210040755.5 and the English translation thereof.

* cited by examiner

LIGHTING DEVICE AND ILLUMINATION APPARATUS INCLUDING SAME

FIELD OF THE INVENTION

The present invention relates to a lighting device and an illumination apparatus including same.

BACKGROUND OF THE INVENTION

Recently, there is an increasing consumer interest in illumination and an illumination apparatus using light emitting diodes (LED elements) as light sources are being diversified. Under these circumstances, there is an increasing number of high-power products and the like in which LED modules, each having multiple LED elements connected in series to each other, are connected in parallel. Further, in order to cope with the wide variability of LEDs, a constant current circuit for supplying a constant current may be provided in the LED modules connected in parallel.

However, in a case where the LED modules are connected in parallel, if some of the LED modules are detached or an open-circuit mode failure occurs therein, there may flow concentrated currents through the other LED modules, and it may lead to destruction and degradation of the LED modules. Even in a case where the current supplied to the entire load is controlled to be constant by using the constant current circuit, the concentrated currents may flow through some of the LED modules. Accordingly, it has been necessary to establish a measure for each LED module.

Thus, there is an illumination apparatus in which a constant current circuit and a connection state detection circuit are provided for each of LED modules connected in parallel (see, e.g., Japanese Patent Application Publication No. 2009-21175). In this illumination apparatus, if it is detected that a certain LED module is detached, the supply of the current to the corresponding LED module is stopped, thereby preventing concentrated currents from flowing through the other LED modules.

Further, there is a lighting circuit which detects an abnormality in an LED load and safely turns on a light source of a vehicle lamp (see, e.g., Japanese Patent Application Publication No. 2004-134147). The lighting circuit supplies a constant current to the entire light source having LED loads connected in parallel. Further, a sense resistor is connected in series to each LED load, and an abnormality such as failure or detachment of an LED load is detected by sensing a voltage across each sense resistor. Further, if an abnormality is detected, the power supplied to the entire LED load is reduced by adjusting a drive signal of a switching regulator, thereby maintaining a safe operation.

However, in the illumination apparatus of Japanese Patent Application Publication No. 2009-21175, since the constant current circuits and the connection state detection circuits need to be provided in the same number as the number of the LED modules connected in parallel, the circuit configuration becomes complicated, and it results in a large power loss due to the constant current circuits and the connection state detection circuits and a low conversion efficiency of the illumination apparatus.

Further, in the illumination apparatus of Japanese Patent Application Publication No. 2004-134147, since the sense resistors need to be provided in the same number as the number of the LED loads connected in parallel, it results in a large power loss due to the sense resistors and a low conversion efficiency of the lighting circuit.

SUMMARY OF THE INVENTION

In view of the above, the present invention provides a lighting device capable of reducing a power loss and preventing concentrated currents from flowing through normally operating light emitting modules when an abnormality develops in the load, and an illumination apparatus including same.

In accordance with an embodiment of the present invention, there is provided a lighting device including: a lighting unit which controls a current being supplied to a load, in which light emitting modules, each having one or more semiconductor light emitting elements connected in series, are connected in parallel, to be a constant current; a current detector which detects a current flowing through one of the light emitting modules; and an abnormality detector which compares a detected value from the current detector with an upper limit and a lower limit of a predetermined current range to detect an abnormality in the load. The abnormality detector detects the abnormality in the load if the detected value from the current detector is larger than the upper limit or smaller than the lower limit, and if the abnormality detector detects the abnormality in the load, the lighting unit reduces the current being supplied to the load.

Further, if the abnormality detector detects the abnormality in the load, the lighting unit may perform an intermittent operation for intermittently reducing the current being supplied to the load, and if the abnormality detector is switched from a state in which the abnormality in the load is detected to a state in which the abnormality in the load is not detected while the lighting unit performs the intermittent operation, the lighting unit may stop the intermittent operation.

Further, as a difference between the upper limit of the predetermined current range and the detected value from the current detector that is larger than the upper limit, or a difference between the lower limit of the predetermined current range and the detected value from the current detector that is smaller than the lower limit increases, the lighting unit may increase a reduction in the current being supplied to the load.

Further, the lighting unit may include a direct current (DC) power supply for outputting a DC power and a constant current supply unit for controlling the current being supplied to the load to be a constant current by using the DC power supply as an input power supply.

Further, the current detector may detect a current flowing through only said one of the light emitting modules.

In accordance with another embodiment of the present invention, there is provided an illumination apparatus including: the lighting device described in claim 1 or 2; and a load, in which light emitting modules, each having one or more semiconductor light emitting elements connected in series, are connected in parallel, and to which a current is supplied from the lighting device.

In accordance with the present invention, it is possible to reduce power loss by a simple configuration, and to prevent a concentrated current from flowing through normally operating light emitting modules when there develops an abnormality in the load.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Hereinafter, embodiments of the present invention will be described with reference to the accompanying drawings, which form a part hereof.

First Embodiment

Figure 1:
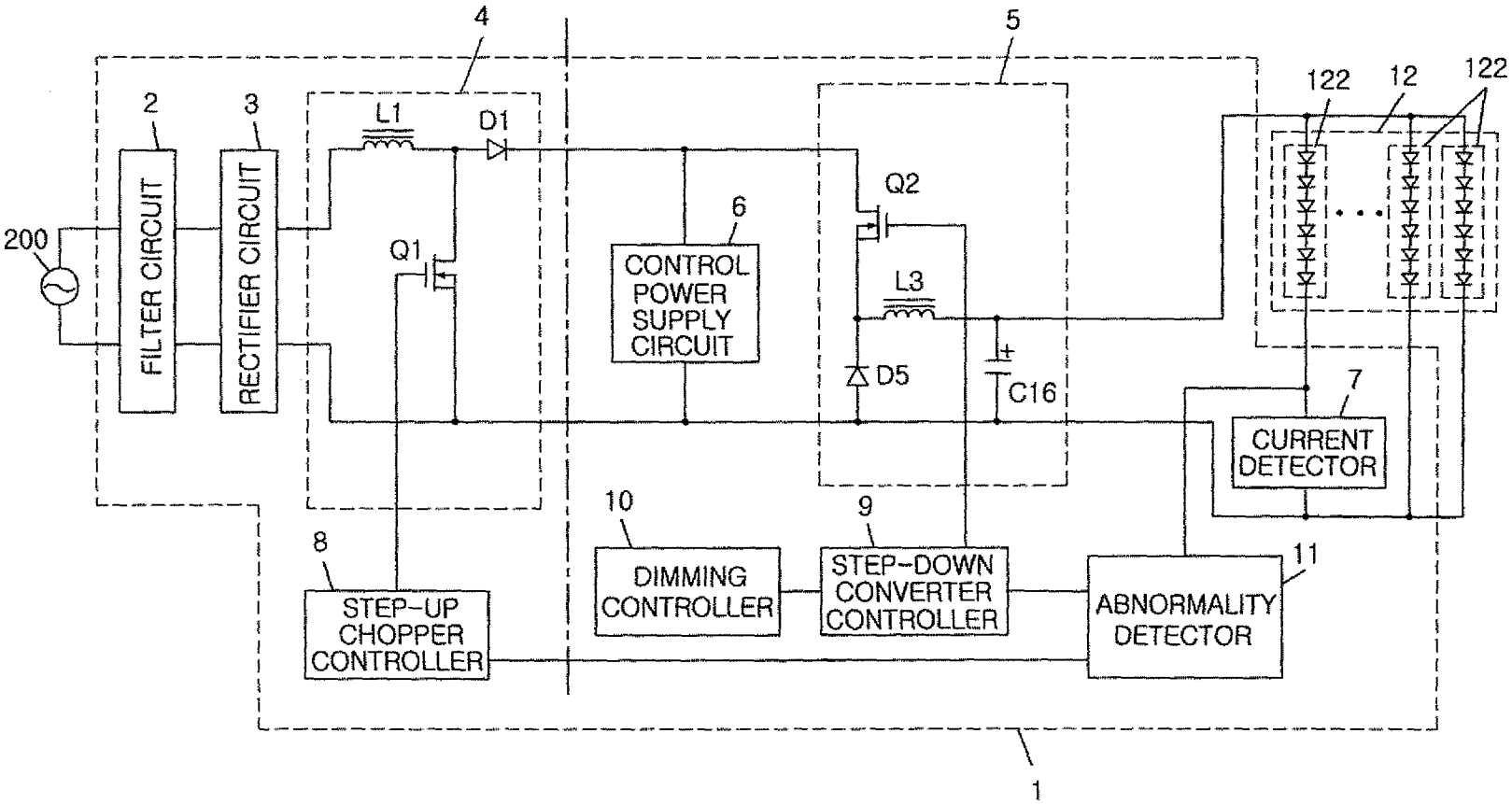
FIG. 1 illustrates a block diagram showing a configuration of a lighting device in accordance with a first embodiment of the present invention.

FIG. 1 illustrates a block diagram showing a configuration of a lighting device 1 in accordance with a first embodiment of the present invention. The lighting device 1 of this embodiment includes a filter circuit 2, a rectifier circuit 3, a step-up chopper circuit 4, a step-down converter 5, a control power supply circuit 6, a current detector 7, a step-up chopper controller 8, a step-down converter controller 9, a dimming controller 10, and an abnormality detector 11.

Each part of the lighting device 1 of this embodiment will be described with reference to a circuit diagram shown in FIG. 2.

A commercial AC power source 200 (e.g., 100 V, 50/60 Hz) is connected between input terminals of the filter circuit 2 via a connector CN1. A fuse F1 is provided between the connector CN1 and the filter circuit 2. A parallel circuit of a varistor (surge voltage protection element) ZNR1 and a filter capacitor C1 is connected between the input terminals of the filter circuit 2. A common mode choke coil (line filter) Lf1 is connected to each input terminal of the filter circuit 2. As the filter circuit 2 is configured as described above, it is possible to reduce a noise component in the input terminal.

The rectifier circuit 3 includes a full-wave rectifier DB1 to which the output of the filter circuit 2 is inputted to full-wave rectify an AC voltage applied from the commercial AC power source 200 and a capacitor C2 for high frequency bypass. As the rectifier circuit 3 is configured as described above, it is possible to full-wave rectify the AC power supplied from the commercial AC power source 200 and generate a ripple voltage at both terminals of the capacitor C2.

Further, a negative electrode of the DC output terminal of the full-wave rectifier DB1 serves as a ground on a circuit board, and is high frequency grounded to a chassis potential FG through a series circuit of capacitors C3 and C4. Hereinafter, a portion having the same potential as the negative electrode of the full-wave rectifier DB1 is referred to as a circuit ground.

Main components of the step-up chopper circuit 4 include an inductor L1, a switching element Q1, a diode D1 and a smoothing capacitor C5. Although the step-up chopper controller 8 is included in the step-up chopper circuit 4 in FIG. 2 for convenience of illustration, the step-up chopper controller 8 is not a component of the step-up chopper circuit 4.

Specifically, a series circuit including the inductor L1, the diode D1 and the smoothing capacitor C5 is connected between the DC output terminals of the full-wave rectifier DB1. A positive electrode of the DC output terminal of the full-wave rectifier DB1 is connected to an anode of the diode D1 through the inductor L1, and a cathode of the diode D1 is connected to a positive electrode of the smoothing capacitor C5. Further, a series circuit including the switching element Q1 containing an n channel MOSFET and a current detection resistor R1 is connected between the circuit ground and a connection node between the inductor L1 and the diode D1.

The switching element Q1 has a drain connected to the anode of the diode D1, a source connected to the circuit ground through the resistor R1, and a gate connected to the step-up chopper controller 8 that will be described later.

In the step-up chopper circuit 4 configured as described above, the switching element Q1 is controlled to be switched at a high frequency by the step-up chopper controller 8. Accordingly, the step-up chopper circuit 4 steps up the ripple voltage outputted from the rectifier circuit 3 to generate a DC voltage (e.g., 410 V) smoothed by the smoothing capacitor C5.

The smoothing capacitor C5 is a large-capacity capacitor including an aluminum electrolytic capacitor or the like, and a small-capacity capacitor C6 for high frequency bypass is connected in parallel to the smoothing capacitor C5. The capacitor C6 includes a film capacitor to bypass a high frequency component flowing through the smoothing capacitor C5.

Next, the step-up chopper controller 8 will be described. The step-up chopper controller 8 includes a power factor correction (PFC) circuit IC1 and its peripheral circuits, and performs switching control of the switching element Q1. Further, the filter circuit 2, the rectifier circuit 3, the step-up chopper circuit 4 and the step-up chopper controller 8 correspond to a DC power supply described in the claims.

The PFC circuit IC1 of this embodiment uses an IC chip of L6562A manufactured by STMicroelectronics (STME), which includes a first pin P11 to an eighth pin 818. Hereinafter, the function and operation of the first pin 811 to the eighth pin 818 will be described.

The eighth pin 818 (Vcc) is a power supply terminal and the sixth pin P16 (GND) is a ground terminal. A control power supply voltage Vcc (hereinafter, referred to as a control voltage Vcc) outputted from the control power supply circuit 6 that will be described later is supplied between the eighth pin P18 and the sixth pin P16. The PFC circuit IC1 is driven by using the control voltage Vcc as an input power supply. Further, a capacitor C11 is connected between the eighth pin P18 and the sixth pin P16. The capacitor C11 is a small-capacity capacitor for power supply bypass to remove noise from the control voltage Vcc.

The seventh pin P17 (GD) is a gate drive terminal, and a series circuit including resistors R14 and R15 is connected between the seventh pin P17 and the circuit ground. Further, a connection node between the resistor R14 and the resistor R15 is connected to a gate of the switching element Q1. Further, a series circuit including a resistor R16 and a diode D2 is connected in parallel to the resistor R14. An anode of the diode D2 is connected to the gate of the switching element Q1.

Further, if the output level of the seventh pin P17 becomes a high level, the current flows into the resistor R15 through the resistor R14 so that the voltage across the resistor R15 increases. Further, if the voltage across the resistor R15 becomes equal to or larger than a gate-source threshold voltage of the switching element Q1, the switching element Q1 is turned on. Further, if the output level of the seventh pin P17 becomes a low level, the charges accumulated between the gate and source of the switching element Q1 are discharged through the diode D2 and the resistor R16, so that the switching element Q1 is turned off.

The fourth pin P14 (CS) is a chopper current detection terminal to detect the current flowing through the switching element Q1 by detecting the voltage across the current detection resistor R1 through a noise filter circuit including a resistor R12 and a capacitor C10. Further, if the detection value is equal to or larger than a threshold value, the seventh pin P17 is set to a low level, so that the switching element Q1 is turned off.

The fifth pint P15 (ZCD) is a zero-cross detection terminal, and is connected to one terminal of a secondary coil n2 of the inductor L1 through a resistor R13. The other terminal of the secondary coil n2 is connected to the circuit ground. Further, the fifth pin P15 detects energy accumulated in the inductor L1, and if it is detected that the energy is no longer discharged from the inductor L1, the seventh pin P17 is set to a high level, so that the switching element Q1 is turned on.

The third pin P13 (MULT) is an input terminal of an internal multiplier circuit (not shown), and detects the ripple voltage outputted from the rectifier circuit 3. The ripple voltage is divided by a resistor R5 and a series circuit including resistors R2 to R4, and the divided voltage is inputted to the third pin P13 of the PFC circuit IC1. Further, a capacitor C7 is connected between the third pin P13 and the circuit ground to remove the noise.

Further, the PFC circuit IC1 controls such that the ON time of the switching element Q1 gets longer as the ripple voltage increases and gets shorter as the ripple voltage decreases. Further, the internal multiplier circuit of the PFC circuit IC1 connected to the third pin P13 is used to control a peak value of the input current inputted from the commercial AC power source 200 through the full-wave rectifier DB1 in a shape similar to a ripple voltage waveform.

The first pin P11 (INV) is an inverting input terminal of an internal error amplifier, and the second pin P12 (COMP) is an output terminal of the internal error amplifier. The first pin P11 detects a DC voltage outputted from the step-up chopper circuit 4. The DC voltage generated across the smoothing capacitor C5 is divided by a series circuit including resistors R6 to R9 and a series circuit including a resistor R10 and a variable resistor VR1, and the divided voltage is inputted to the first pin P11. Further, if the detection value is higher than a target voltage, it is controlled such that the ON time of the switching element Q1 becomes shorter. If the detection value is lower than the target voltage, it is controlled such that the ON time of the switching element Q1 becomes longer. Further, capacitors C8 and C9 and a resistor R11 connected between the first pin P11 and the second pin P12 form a feedback impedance of the internal error amplifier of the PFC circuit IC1.

Next, the control power supply circuit 6 will be described. The control power supply circuit 6 of this embodiment includes an IPD element IC2 and its peripheral circuits. The IPD element IC2 is a so-called intelligence power device, and uses, e.g., MIP2E2D manufactured by Panasonic Corporation.

The IPD element IC2 is a three-pin IC having a drain terminal P21, a source terminal P22 and a control terminal P23. The IPD element 102 has a switching element including a power MOSFET and a control circuit for controlling a switching operation of the switching element.

Further, the internal switching element of the IPD element 102, an inductor L2, a smoothing capacitor C12 and a diode D3 are included in a step-down chopper circuit. Specifically, the drain terminal P21 of the IPD element IC2 is connected to a positive electrode of the smoothing capacitor C5, and the source terminal P22 is connected to a positive electrode of the smoothing capacitor C12 through the inductor L2. Further, the diode D3 is connected in parallel to a series circuit including the inductor L2 and the smoothing capacitor C12, and a cathode of the diode D3 is connected to the inductor L2.

Further, a power supply circuit of the IPD element IC2 includes a Zener diode ZD1, a diode D4, a smoothing capacitor C14, and a capacitor C15. A parallel circuit including the smoothing capacitor C14 and the capacitor C15 is connected between the control terminal P23 and the source terminal P22 of the IPD element IC2. A positive electrode of the smoothing capacitor C14 is connected to the control terminal P23. Further, a series circuit including the Zener diode ZD1, the diode D4 and the smoothing capacitor C14 is connected in parallel to the inductor L2. A cathode of the Zener diode ZD1 is connected to the inductor L2, and a cathode of the diode D4 is connected to the smoothing capacitor C14. Further, a capacitor C13 is connected between the drain terminal P21 of the IPD element 102 and the circuit ground to remove the noise.

In an initial stage when a power is inputted from the commercial AC power source 200, the smoothing capacitor C5 is charged by the ripple voltage outputted from the full-wave rectifier DB1 through the inductor L1 and the diode D1. Further, as the smoothing capacitor C5 is charged, the current flows in a path including the drain terminal P21 of the IPD element IC2→the control terminal P23→the smoothing capacitor C14→the inductor L2→the smoothing capacitor C12, thereby charging the smoothing capacitor C14. The voltage across the smoothing capacitor C14 becomes an operation power supply to an internal control circuit of the IPD element 102, so that the operation of the IPD element 102 is started and the switching operation of the internal switching element of the IPD element 102 is controlled.

If the switching element of the IPD element 102 is in an ON state, the current flows in a path including the smoothing capacitor C5→the drain terminal P21→the source terminal P22→the inductor L2→the smoothing capacitor C12, thereby charging the smoothing capacitor C12. Further, if the switching element of the IPD element 102 is in an OFF state, the accumulated energy at the inductor L2 is discharged to the smoothing capacitor C12 through the diode D3. By repeating the ON/OFF operation described above, the control voltage Vcc, to which the voltage across the smoothing capacitor C5 is stepped down, is generated across the smoothing capacitor C12.

Further, if the switching element of the IPD element IC2 is in an OFF state, a flyback current flows through the diode D3. However, in this case, the voltage across the inductor L2 is clamped to the sum of the voltage across the smoothing capacitor C12 and the forward voltage of the diode D3. The voltage obtained by subtracting the sum of the Zener voltage of the Zener diode ZD1 and the forward voltage of the diode D4 from the voltage across the inductor L2 becomes the voltage across the smoothing capacitor C14. Further, the internal control circuit of the IPD element 102 controls the switching operation of the internal switching element of the IPD element 102 such that the voltage across the smoothing capacitor C14 becomes constant. Accordingly, the voltage across the smoothing capacitor C12 is controlled to be constant, and the smoothing capacitor C14 is charged so that the IPD element 102 can be continuously driven.

The control power supply circuit 6 configured as described above supplies the control voltage Vcc to the step-up chopper controller 8, the step-down converter controller 9 and the dimming controller 10 while the voltage across the smoothing capacitor C12 serves as the output voltage thereof. Hereinafter, a portion having the same potential as the control voltage Vcc is referred to as a control power supply.

Next, the step-down converter 5 for stepping down the DC voltage generated across the smoothing capacitor C5 will be described.

The step-down converter 5 includes a step-down chopper circuit including a switching element Q2, an inductor L3, a smoothing capacitor C16, and a diode D5. Specifically, a series circuit including the switching element Q2, the inductor L3 and the smoothing capacitor C16 is connected in parallel to the smoothing capacitor C5. The diode D5 is connected in parallel to the series circuit of the inductor L3 and the smoothing capacitor C16. The switching element Q2 includes an n channel MOSFET, and has a drain terminal connected to a positive electrode of the smoothing capacitor C5, and a source terminal connected to a positive electrode of the smoothing capacitor C16 through the inductor L3. Further, an anode of the diode D5 is connected to a negative electrode of the smoothing capacitor C16 and a cathode of the diode D5 is connected to the inductor L3.

Further, if the switching element Q2 is turned on, the current flows, from the smoothing capacitor C5, in a path including the switching element Q2→the inductor L3 the smoothing capacitor C16. Further, if the switching element Q2 is turned off, the energy accumulated in the inductor L3 is discharged to the smoothing capacitor C16 through the diode D5. Further, by repeating the ON/OFF operation described above, the voltage, to which the DC voltage across the smoothing capacitor C5 is stepped down, is generated across the smoothing capacitor C16.

The step-down converter 5 configured as described above controls the current supplied to a load 12 (hereinafter, referred to as LED current Io) to be constant while the voltage across the smoothing capacitor C16 serves as the output voltage thereof. The load 12 is configured by connecting LED modules 122 in parallel, each LED module having LED elements 121 connected in series to each other. The load 12 of this embodiment is configured by connecting two LED modules 122 in parallel. The LED modules 122 may be respectively referred to as LED modules 122*a* and 122*b*. Further, the current detector 7 is connected in series to the LED module 122*a*. Further, each of the LED elements 121 is turned on by the LED current Io supplied from the step-down converter 5.

Next, the step-down converter controller 9 will be described.

The step-down converter controller 9 includes timer integrated circuits IC3 and IC4, and their peripheral circuits. The timer integrated circuits IC3 and IC4 are well-known timer ICs (so-called 555 timer circuits), and may employ, e.g., μPD5555 manufactured by Renesas Electronics Corporation, μPD5556 of its dual version, or a compatible product thereof.

The timer integrated circuits IC3 and IC4 include first pins P31 and P41 to eighth pins P38 and P48, respectively, to which the peripheral circuits are connected. Hereinafter, the function and operation of the first pins P31 and P41 to the eighth pins P38 and P48 of the timer integrated circuits IC3 and IC4 will be described.

The eighth pins P38 and P48 are power supply terminals and the first pins P31 and P41 are ground terminals. The control voltage Vcc is supplied between each of the eighth pins P38 and P48 and the corresponding first pins P31 and P41. Further, a capacitor C17 is connected between the eighth pin P38 and the first pin P31 of the timer integrated circuit IC3. A capacitor C18 is connected between the eighth pin P48 and the first pin P41 of the timer integrated circuit IC4. The capacitors C17 and C18 are small-capacity capacitors for power supply bypass to remove the noise of the control voltage Vcc.

The fifth pins P35 and P45 are control terminals, and a reference voltage Vb1 that is ⅔ of the control voltage Vcc is applied to each of the fifth pins P35 and P45 by an internal resistor divider. Further, a capacitor C19 is connected between the fifth pin P35 and the first pin P31 of the timer integrated circuit IC3. A capacitor C20 is connected between the fifth pin P45 and the first pin P41 of the timer integrated circuit IC4. The capacitors C19 and C20 are small-capacity capacitors for bypass to remove the noise of the reference voltage Vb1 applied to each of the fifth pins P35 and P45.

The sixth pins P36 and P46 are threshold terminals, and if a voltage applied to each of the sixth pins P36 and P46 is higher than the reference voltage Vb1, an internal flip-flop is inverted.

Further, the output level of each of the third pins P33 and P43 serving as output terminals becomes a low level. Further, the seventh pins P37 and P47 serving as discharge terminals are short-circuited to the first pins P31 and P41 (circuit ground), respectively.

The second pins P32 and P42 are trigger terminals, and if a voltage applied to each of the second pins 932 and 942 is lower than a reference voltage Vb2 that is ½ of the reference voltage Vb1, an internal flip-flop is inverted. Further, the output level of each of the third pins 933 and 943 becomes a high level, and the seventh pins 937 and P47 turn into an open-circuit state.

The fourth pins P34 and P44 are reset terminals. If a voltage applied to each of the fourth pins P34 and P44 is less than 2V, the operation is stopped and the output level of each of the third pins P33 and P43 is fixed to a low level.

Next, an operation of each of the timer integrated circuits IC3 and IC4 will be described in detail. Hereinafter, the timer integrated circuit IC3 is referred to as a high frequency oscillation circuit IC3, and the timer integrated circuit IC4 is referred to as a pulse width setting circuit IC4.

First, an operation of the high frequency oscillation circuit IC3 will be described in detail.

Resistors R17 and R18 and a capacitor C21 which determine a time constant are connected, as peripheral circuits, to the high frequency oscillation circuit IC3, and the high frequency oscillation circuit IC3 operates as an astable multivibrator.

A series circuit including the resistors R17 and R18 and the capacitor C21 is connected between the control power supply and the circuit ground. A connection node between the resistors R17 and R18 is connected to the seventh pin P37, and a connection node between the resistor R18 and the capacitor C21 is connected to the second pin P32 and the sixth pin P36.

Further, the voltage across the capacitor C21 is applied to the second pin P32 and the sixth pin P36 to be compared with the reference voltages Vb2 and Vb1, respectively.

In an initial power input, since the voltage across the capacitor C21 is lower than the reference voltage Vb2 at the second pin P32, the output level of the third pin P33 becomes a high level, and the seventh pin P37 is in an open-circuit state. Accordingly, the current flows through the capacitor C21 from the control power supply through the resistors R17 and R18, thereby charging the capacitor C21.

By the charging operation, if the capacitor C21 is charged and the voltage across the capacitor C21 becomes higher than the reference voltage Vb1 at the sixth pin P36, the output level of the third pin P33 becomes a low level and the seventh pin P37 is short-circuited to the first pin P31. Accordingly, the current flows from the capacitor C21 to the circuit ground through the resistor R18, thereby discharging the capacitor C21.

By the discharging operation, the capacitor C21 is discharged, and the voltage across the capacitor C21 decreases. If the voltage across the capacitor C21 is lower than the reference voltage Vb2 at the second pin P32, the output level of the third pin P33 becomes a high level, and the seventh pin P37 turns into an open-circuit state. Accordingly, the capacitor C21 gets charged again. Then, the above-described charging operation and discharging operation are repeatedly performed.

The time constant determined by the resistors R17 and R18 and the capacitor C21 is set such that the oscillation frequency of the third pin P33 is several tens of kHz.

Further, the resistance of the resistor R17 is set to be sufficiently smaller than the resistance of the resistor R18. Thus, the period during which the capacitor C21 has been charged (the third pin P33 has a low level) is extremely reduced. Accordingly, at the third pin P33, a pulse signal having a short low level pulse width is repeatedly outputted at a frequency of several tens of kHz. The second pin P42 of the pulse width setting circuit IC4 is triggered only once every cycle by using a falling edge of the pulse signal.

Next, an operation of the pulse width setting circuit IC4 will be described in detail.

The resistor R19 and a variable resistor VR2 and a capacitor C22 which determine a time constant are connected, as peripheral circuits, to the pulse width setting circuit IC4, and the pulse width setting circuit IC4 operates as a monostable multivibrator. A series circuit including the variable resistor VR2 and the resistor R19 and the capacitor C22 is connected between the control power supply and the circuit ground. The sixth pin P46 and the seventh pin P47 are connected to a connection node between the resistor R19 and the capacitor C22. Further, a light receiving element PC11 of a photocoupler PC1 is connected in parallel to a series circuit including the R19 and the variable resistor VR2. The pulse width of the monostable multivibrator is variably controlled based on the intensity of an optical signal of a light emitting element PC12 of the photocoupler PC1.

The second pin P42 of the pulse width setting circuit IC4 is connected to the third pin P33 of the high frequency oscillation circuit IC3 and a pulse signal having a short low level pulse width is inputted thereto from the third pin P33 of the high frequency oscillation circuit IC3. Further, at a falling edge of the pulse signal, the third pin P43 of the pulse width setting circuit IC4 has a high level and the seventh pin P47 is in an open state. Accordingly, the capacitor C22 is charged by the control power supply through the series circuit including the resistor R19 and the variable resistor VR2 and the light receiving element PC11 of the photocoupler PC1.

If the voltage across the capacitor C22 becomes higher than the reference voltage Vb1 at the sixth pin P46 by the charging operation, the output level of the third pin P43 becomes a low level, and the seventh pin P47 becomes short-circuited to the first pin P41. Accordingly, the capacitor C22 is discharged instantaneously.

Accordingly, the high level period of the pulse signal outputted from the third pin P43 of the pulse width setting circuit IC4 is determined by the time required for charging the capacitor C22 from the ground potential to the reference voltage Vb2. The maximum value of the charging time is set to be shorter than the oscillation period of the high frequency oscillation circuit IC3. Further, the minimum value of the charging time is set to be longer than the low level period of the pulse signal outputted from the third pin P33 of the high frequency oscillation circuit IC3.

The third pin P43 is connected to a parallel circuit including an electrolytic capacitor C23 and a diode D6 through a primary coil T11 of the transformer T1.

One terminal of the primary coil T11 of the transformer T1 is connected to the third pin P43, and the other terminal of the primary coil T11 is connected to a positive electrode of the electrolytic capacitor C23 and a cathode of the diode D6. Further, a series circuit including resistors R20 and R21 is connected between both terminals of a secondary coil T12 of the transformer T1. One terminal of the secondary coil T12 is connected to the source of the switching element Q2. Further, the resistor R21 is connected between the source and gate of the switching element Q2. Further, a series circuit including a diode D7 and a resistor R22 is connected in parallel to the resistor R20. An anode of the diode D7 is connected to the gate of the switching element Q2.

Further, a switching operation of the switching element Q2 is controlled by using the pulse signal outputted from the third pin P43 of the pulse width setting circuit IC4.

If the pulse signal outputted from the third pin P43 is of a high level, the current flows in the electrolytic capacitor C23 through the primary coil T11 of the transformer T1 to thereby charge the electrolytic capacitor C23.

In this case, an induced electromotive force is generated at the secondary coil T12 of the transformer T1, and the current flows through the resistors R20 and R21, so that the voltage across the resistor R21 increases. Further, if the voltage across the resistor R21 becomes equal to or higher than the gate-source threshold voltage of the switching element Q2, the switching element Q2 is turned on.

Further, if the pulse signal outputted from the third pin P43 is of a low level, the current flows from the electrolytic capacitor C23 through the primary coil T11. Accordingly, at the secondary coil T12, the electric charges between the gate and source of the switching element Q2 are discharged through the diode D7 and the resistor R22, so that the switching element Q2 is turned off.

By repeating the above operation, the pulse width setting circuit IC4 controls the switching operation of the switching element Q2.

Further, the control voltage Vcc is applied to the fourth pin P34 of the high frequency oscillation circuit IC3, and a voltage obtained by dividing the control voltage Vcc by resistors R23 and R24 is applied to the fourth pin P44 of the pulse width setting circuit IC4. Accordingly, after the control power supply circuit 6 is driven to output the control voltage Vcc, the high frequency oscillation circuit IC3 and the pulse width setting circuit IC4 are driven.

Next, the dimming controller 10 will be described.

A dimming signal inputted to the dimming controller 10 is a PWM signal including a square wave voltage signal with a variable pulse width, having a frequency of 1 kHz and an amplitude of 10 V. The dimming signal is widely used as a dimming signal of an inverter lighting device of a fluorescent lamp. Further, a dimming signal line through which the dimming signal is transmitted is provided in each illumination apparatus separately from a power line.

A full-wave rectifier DB2 is connected to an input terminal of the dimming controller 10 of this embodiment. Accordingly, even though a dimming signal line is connected with reverse polarity, the dimming controller 10 operates normally. A series circuit including resistors R25 and R26 and a light emitting element PC22 of a photocoupler PC2 is connected to an output terminal of the full-wave rectifier DB2. A Zener diode ZD2 is connected in parallel to a series circuit including the resistor R26 and the light emitting element PC22.

The photocoupler PC2 functions as an insulation circuit. Generally, a plurality of illumination apparatuses is connected in parallel to the dimming signal line and the power line. In such case, since the circuit ground of each illumination apparatus does not have the same potential, it is necessary to insulate the dimming signal line from the circuit ground of each illumination apparatus.

The light emitting element PC22 of the photocoupler PC2 is connected to the dimming signal line through the resistors R25 and R26 and the full-wave rectifier DB2. Further, a series circuit including a light receiving element PC21 of the photocoupler PC2 and a resistor R27 is connected between the control power supply and the circuit ground.

If the dimming signal (PWM signal) inputted through the dimming signal line is of a high level, the luminous flux from the light emitting element PC22 of the photocoupler PC2 increases, so that the on-resistance of the light receiving element PC21 decreases and the current flowing through the light receiving element PC21 increases. Accordingly, the voltage at a connection node between the resistor R27 and the light receiving element PC21 decreases. Hereinafter, the voltage at the connection node between the resistor R27 and the light receiving element PC21 is referred to as a dimming voltage.

Further, if the dimming signal is of a low level, the luminous flux from the light emitting element PC22 decreases, so that the on-resistance of the light receiving element PC21 increases and the current flowing in the light receiving element PC21 decreases. Accordingly, the dimming voltage increases.

The dimming voltage is inputted to an integrated circuit IC5 (hereinafter, referred to as a dimming circuit IC5) including operational amplifiers A1 and A2. The dimming circuit IC5, a resistor R28 and a capacitor C24 are included in a DC conversion circuit. A change in the dimming voltage is repeated at a frequency (1 kHz) of the dimming signal, but is smoothed by a time constant circuit including the resistor R28 and the capacitor C24 to be converted into a DC voltage.

The dimming circuit IC5 employs, e.g., μPC358 manufactured by Renesas Electronics Corporation or a compatible product thereof. The dimming circuit IC5 is driven by the supply of the control voltage Vcc.

The operational amplifier A1 is used as a buffer amplifier. In the operational amplifier A1, a dimming voltage is applied to a non-inverting input terminal, an inverting input terminal is connected to an output terminal, and the output terminal is connected to the circuit ground through a series circuit including the resistor R28 and the smoothing capacitor C24. Further, the operational amplifier A1 converts the high impedance input dimming voltage into a low impedance output voltage, and performs charging and discharging of the smoothing capacitor C24 through the resistor R28.

If a low level period of the dimming signal is long, the period during which the capacitor C24 is charged through the resistor R28 becomes long, so that the voltage across the smoothing capacitor C24 increases. Further, if a high level period of the dimming signal is long, the period during which the capacitor C24 is discharged through the resistor R28 becomes long, so that the voltage across the smoothing capacitor C24 decreases.

The operational amplifier A2 is used as a buffer amplifier, and a positive electrode of the smoothing capacitor C24 is connected to a non-inverting input terminal thereof. Further, an inverting input terminal of the operational amplifier A2 is connected to an output terminal of the operational amplifier A2, and the output terminal is connected to the control power supply through the light emitting element PC12 of the photocoupler PC1 and the resistor R29. Further, the high impedance input voltage across the capacitor C24 is converted into a low impedance output voltage by the buffer amplifier including the operational amplifier A2 and, then, the low impedance voltage is outputted, so that the light emitting element PC12 of the photocoupler PC1 is driven.

When the voltage across the smoothing capacitor C24 is low, the output voltage of the operational amplifier A2 is also low. Accordingly, the current flowing in the light emitting element PC12 from the control power supply through the resistor R29 increases, so that the luminous flux increases. Consequently, the on-resistance of the light receiving element PC11 decreases, and the current flowing in the light receiving element PC11 increases. That is, if the high level period of the dimming signal becomes long, the ON pulse width of the switching element Q2 set by the pulse width setting circuit IC4 is reduced, so that the LED current Io outputted from the step-down converter 5 decreases.

Further, if the voltage across the smoothing capacitor C24 is high, the output voltage of the operational amplifier A2 becomes high. Accordingly, the current flowing in the light emitting element PC12 from the control power supply through the resistor R29 decreases, so that the luminous flux decreases. Consequently, the on-resistance of the light receiving element PC11 increases, and the current flowing in the light receiving element PC11 decreases. That is, if the low level period of the dimming signal becomes long, the ON pulse width of the switching element Q2 set by the pulse width setting circuit IC4 becomes long, so that the LED current Io outputted from the step-down converter 5 increases.

Further, in a case where the dimming signal line is disconnected, the dimming signal always becomes to be of a low level, so that the LED current Io becomes to be of a maximum level and all lights are turned on.

Further, the step-down converter 5, the step-down converter controller 9 and the dimming controller 10 correspond to a constant current supply unit described in the claims. Further, the filter circuit 2, the rectifier circuit 3, the step-up chopper circuit 4, the step-down converter 5, the control power supply circuit 6, the step-up chopper controller 8, the step-down converter controller 9, and the dimming controller 10 correspond to a lighting unit described in the claims.

Figure 3:
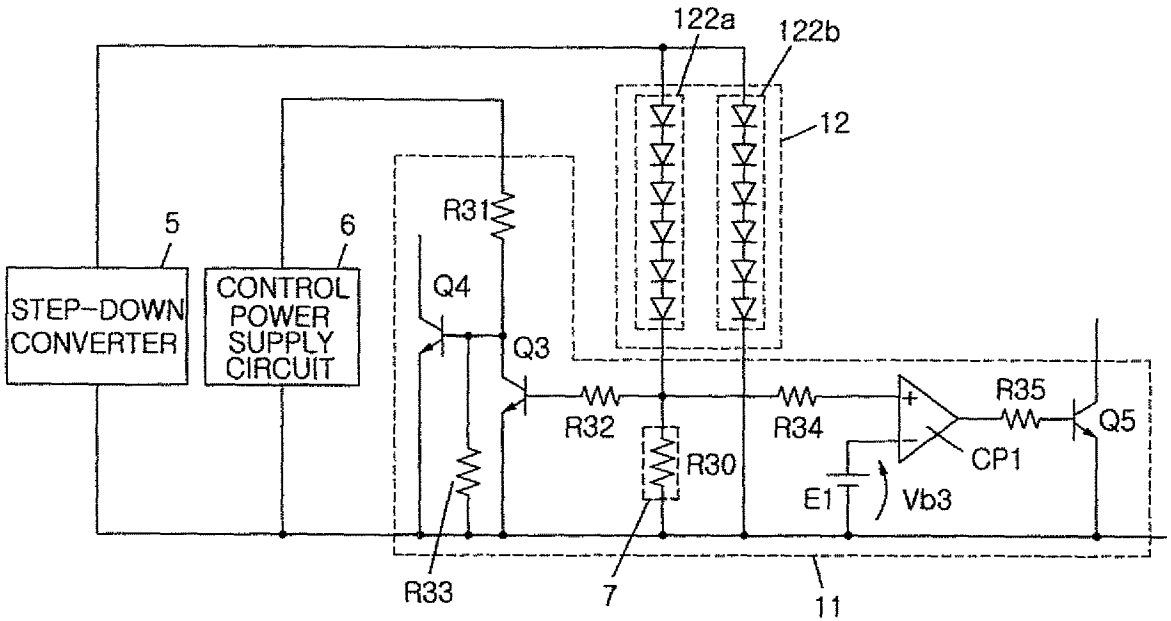
FIG. 3 illustrates a circuit diagram showing a configuration of an abnormality detector of the lighting device in accordance with the first embodiment of the present invention.

Next, the current detector 7 and the abnormality detector 11 will be described with reference to FIG. 3.

The current detector 7 is configured as a resistor R30, and connected in series to the LED module 122*a* to detect the current flowing through the LED module 122*a*.

The abnormality detector 11 detects an abnormality in the load 12 based on an increase/decrease of a voltage across the resistor R30. The abnormality detector 11 includes switching elements Q3 to Q5, resistors R31 to R35, a comparator CP1, and a reference voltage generator E1. Although the current detector 7 is included in the abnormality detector 11 in FIG. 3 for convenience of illustration, the current detector 7 is not a component of the abnormality detector 11.

A series circuit including the resistor R31 and the switching element Q3 is connected between outputs (between the control power supply and the circuit ground) of the control power supply circuit 6. The switching element Q3 includes an NPN transistor having a collector connected to the control power supply through the resistor R31 and an emitter connected to the circuit ground. Further, a series circuit including the resistors R30 and R32 is connected between a base and the emitter of the switching element Q3. A voltage across the resistor R30 is applied to the base of the switching element Q3 through the resistor R32.

Further, the collector of the switching element Q3 is connected to a resistor R33 and the switching element Q4. The switching element Q4 includes an NPN transistor having an emitter connected to the circuit ground. The resistor R33 is connected between a base and the emitter of the switching element Q4, and a voltage across the resistor R30 is applied to the base of the switching element Q4.

Further, a non-inverting input terminal of the comparator CP1 is connected to the resistor R30 through the resistor R34, and the voltage across the resistor R30 is applied to the non-inverting input terminal. Further, an inverting input terminal of the comparator CP1 is connected to the reference voltage generator E1, and a reference voltage Vb3 is applied to the inverting input terminal. An output terminal of the comparator CP1 is connected to a base of the switching element Q5 including an NPN transistor through the resistor R35. Further, an emitter of the switching element Q5 is connected to the circuit ground.

Further, the abnormality detector 11 detects an abnormality in the load 12 based on whether the voltage across the resistor R30 is within a predetermined range. If the voltage across the resistor R30 is within the predetermined range, the abnormality detector 11 has an output state in which the abnormality in the load 12 is not detected. If the voltage across the resistor R30 is out of the predetermined range, the abnormality detector 11 has an output state in which the abnormality in the load 12 is detected. In other words, if the current flowing in the LED module 122*a* is larger than an upper limit, or smaller than a lower limit of the predetermined current range, it is determined that an abnormality in the load 12 is detected. Further, if the abnormality detector 11 detects the abnormality in the load 12, the output state thereof is switched by turning on either the switching element Q4 or the switching element Q5 based on that the current flowing in the LED module 122*a* is larger than an upper limit, or smaller than a lower limit.

For example, if the LED module 122*a* is detached or in an open-circuit mode failure, or if the LED module 122*b* is in a short-circuit mode failure, the current does not flow through the LED module 122*a*. Accordingly, the voltage across the resistor R30 is reduced to almost zero, and the switching element Q3 is turned off. When the switching element Q3 is turned off, the voltage across the resistor R33 increases and the switching element Q4 is turned on. Further, the open-circuit mode failure indicates a failure in a state where both terminals of the LED module 122 are insulated, and the short-circuit mode failure indicates a failure in a state where both terminals of the LED module 122 are short-circuited.

Further, if the LED module 122*b* is detached or in an open-circuit mode failure, or if the LED module 122*a* is in a short-circuit mode failure, the current flowing through the LED module 122*a* increases. Accordingly, the voltage across the resistor R30 increases. If the voltage across the resistor R30 is higher than the reference voltage Vb3, the output level of the comparator CP1 becomes a high level, and the switching element Q5 is turned on.

That is, if the voltage across the resistor R30 is equal to or higher than an upper limit of a predetermined range, the switching element Q5 is turned on. If the voltage across the resistor R30 is equal to or lower than a lower limit of the predetermined range, the switching element Q4 is turned on.

Further, each collector of the switching elements Q4 and Q5 is connected to at least one of the fourth pin P44 of the pulse width setting circuit IC4, the fifth pint P15 of the PFC circuit IC1, and the non-inverting input terminal of the operational amplifier A2 of the dimming circuit IC5.

In a case where the collectors of the switching elements Q4 and Q5 are connected to the fourth pin P44 of the pulse width setting circuit IC4, for example, if one of the switching elements Q4 and Q5 is turned on, the fourth pin P44 is short-circuited to the circuit ground. Accordingly, since the operation of the pulse width setting circuit IC4 is stopped, and the switching operation of the switching element Q2 is stopped, the LED current Io is not supplied to the load 12.

In a case where the collectors of the switching elements Q4 and Q5 are connected to the fifth pin P15 of the PFC circuit IC1, for example, if one of the switching elements Q4 and Q5 is turned on, the fifth pin P15 is short-circuited to the circuit ground. Accordingly, since the operation of the switching element Q1 is stopped, the LED current Io is not supplied to the load 12.

In a case where the collectors of the switching elements Q4 and Q5 are connected to the non-inverting input terminal of the operational amplifier A2 of the dimming circuit IC5, for example, if one of the switching elements Q4 and Q5 is turned on, the positive electrode of the capacitor C24 is short-circuited to the circuit ground. Accordingly, the ON pulse width of the switching element Q2 decreases, and the LED current Io is reduced (suppressed).

Further, it may be configured to increase the voltage applied to the first pin P11 of the PFC circuit IC1 by turning on one of the switching elements Q4 and Q5. Accordingly, the output of the step-up chopper circuit 4 is suppressed and, thus, the LED current Io is reduced (suppressed).

Further, the collectors of the switching elements Q4 and Q5 may be connected to the same location or different locations of the above-mentioned locations. Further, the collectors of the switching elements Q4 and Q5 may be connected to multiple locations of the above-mentioned locations.

Thus, in this embodiment, the current flowing in only one LED module 122 among the LED modules 122 connected in parallel to each other is detected, and the presence of an abnormality in the load 12 is detected based on the detected current value. Further, if the abnormality in the load 12 is detected, the LED current Io is reduced, thereby preventing the concentrated current from flowing through the normally operating LED module 122.

Further, since there is no need to provide an abnormality detection unit for each of the LED modules 122, the circuit configuration becomes simple, thereby reducing the costs. Further, since the current detector 7 is provided only for one module, i.e., the LED module 122*a*, the power loss due to the current detector 7 is suppressed, and the overall conversion efficiency of the lighting device 1 is improved.

Further, in this embodiment, the constant current supply unit (the step-down converter 5, the step-down converter controller 9 and the dimming controller 10) is used and the LED current Io (constant current) is commonly supplied to the LED modules 122. Accordingly, since the constant current circuit is not provided for each of the LED modules 122, the power loss due to the constant current circuit is suppressed, and the overall conversion efficiency of the lighting device 1 is improved.

Further, in this embodiment, the collectors of the switching elements Q4 and Q5 are connected to the non-inverting input terminal of the operational amplifier A2 of the dimming circuit IC5, and if the abnormality in the load 12 is detected, the LED current Io is reduced. Accordingly, the normally operating LED modules 122 may be continuously turned on.

Figure 4:
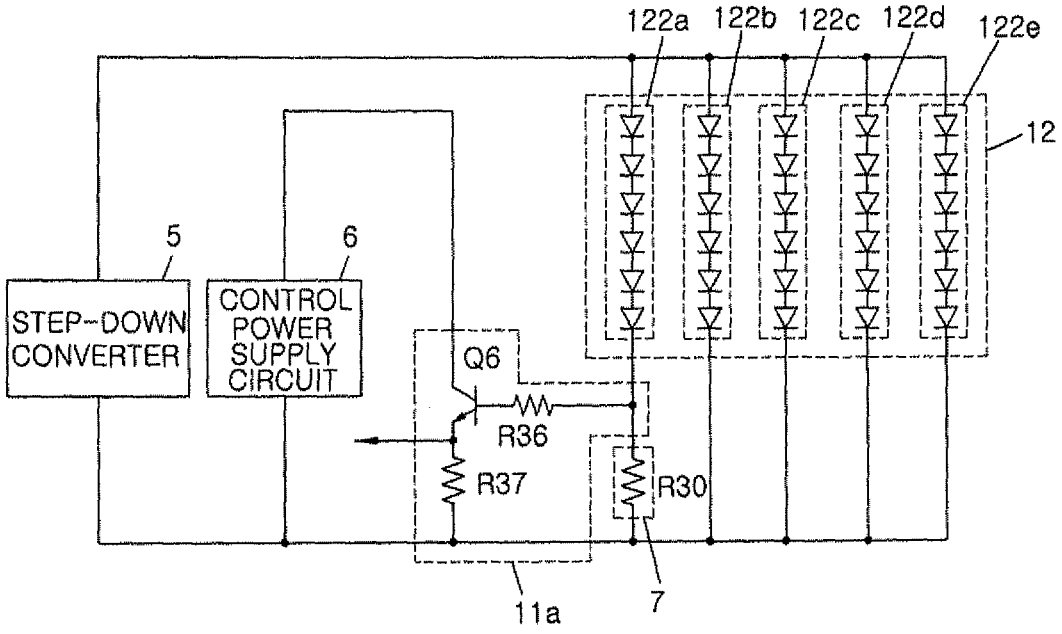
FIG. 4 illustrates a circuit diagram showing another configuration of the abnormality detector of the lighting device in accordance with the first embodiment of the present invention.

Further, the number of the LED modules 122 is not limited to two, and three or more LED modules 122 may be included in the load 12. For example, as shown in FIG. 4, five LED modules 122*a* to 122*e* may form the load 12. Also in this case, if any one of the LED modules 122*b* to 122*e* other than the LED module 122*a* is detached or in an open-circuit mode failure, or if the LED module 122*a* is in a short-circuit mode failure, the current flowing through the LED module 122*a* increases. Further, if the LED module 122*a* is detached or in an open-circuit mode failure, or if the LED modules 122*b* to 122*e* other than the LED module 122*a* are in a short-circuit mode failure, the current flowing through the LED module 122*a* decreases. Accordingly, the LED lighting device 1 can detect the presence of an abnormality in the entire load 12.

Further, the configuration of the abnormality detector 11 is not limited thereto. For example, as shown in FIG. 4, it may be configured such that resistors R36 and R37 and a switching element Q6 are included in an abnormality detector lie so as to detect an increase in the voltage across the resistor R30. The switching element Q6 has a collector connected to the control power supply, an emitter connected to the circuit ground through the resistor R37, and a base connected to the resistor R30 through the resistor R36. Further, the emitter of the switching element Q6 is connected to the first pin P11 of the PFC circuit IC1. The PFC circuit IC1 detects the presence of an abnormality in the load 12 based on the detected value of the abnormality detector 11*a*. If the abnormality in the load 12 is detected, the LED current Io is reduced (suppressed). Further, in this case, the abnormality detector 11*a* and the PFC circuit IC1 correspond to an abnormality detection unit described in the claims.

Specifically, as the number of the LED modules 122 which are detached or in an open-circuit mode failure among the LED modules 122*b* to 122*e* increases, the voltage across the resistor R30 continuously increases. Accordingly, the on-resistance of the switching element Q6 decreases, and the current flowing between the collector and emitter continuously increases. Further, since the voltage across the resistor R37 continuously increases, the voltage applied to the first pin P11 of the PFC circuit IC1 also continuously increases. Accordingly, the output of the step-up chopper circuit 4 is continuously reduced, and the LED current Io also is continuously reduced.

That is, as the number of the LED modules 122 which are detached or in an open-circuit mode failure among the LED modules 122*b* to 122*e* other than the LED module 122*a* increases, a difference between the current value flowing through the LED module 122*a* and the upper limit of the current range increases. Therefore, as the difference increases, the lighting device 1 of this embodiment increases a reduction in the LED current Io to thereby prevent the excessive current from flowing through the normally operating LED modules 122.

Further, it may be configured such that as a difference between the current value flowing through the LED module 122*a* and the lower limit of the current range increases, a reduction in the LED current Io increases. Accordingly, it is possible to prevent the excessive current from flowing through the normally operating LED modules 122.

Figure 2:
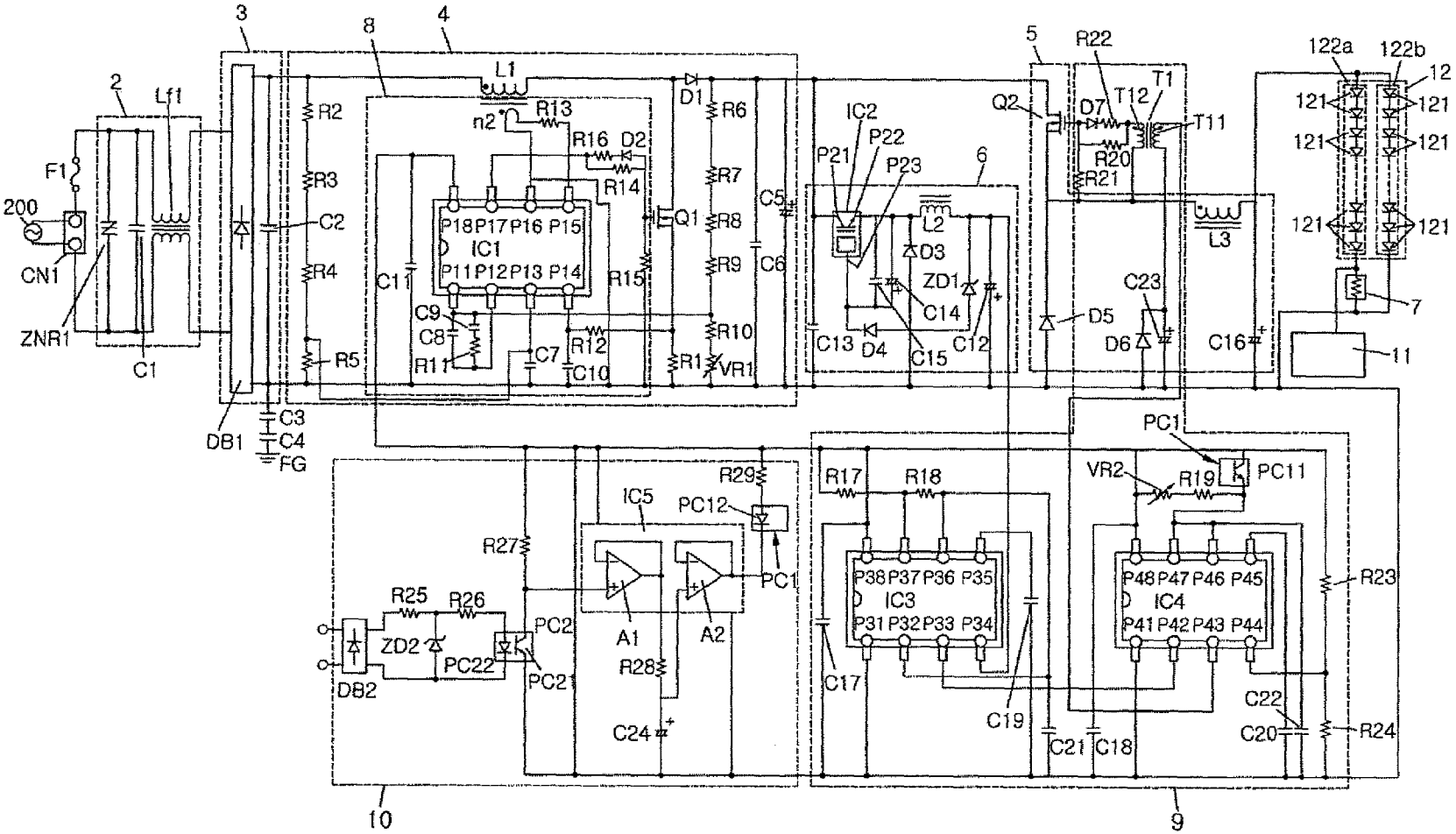
FIG. 2 illustrates a circuit diagram showing the configuration of the lighting device in accordance with the first embodiment of the present invention.

Further, the circuit configuration of the step-down converter 5 of this embodiment includes the switching element Q2, the diode D5, the inductor L3 and the smoothing capacitor C16 as shown in FIG. 2, but it is not limited thereto.

Figure 5A:
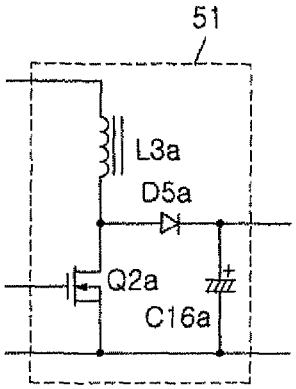
FIGS. 5A to 5E illustrate circuit diagrams showing configuration examples of a step-down converter of the lighting device in accordance with the first embodiment of the present invention.

For example, a step-up chopper circuit 51 shown in FIG. 5A may be employed instead. The step-up chopper circuit 51 includes a series circuit of an inductor L3*a* and a switching element Q2*a*, and a series circuit of a diode D5*a* and a smoothing capacitor C16*a* connected in parallel to a switching element Q2*a*.

Figure 5B:
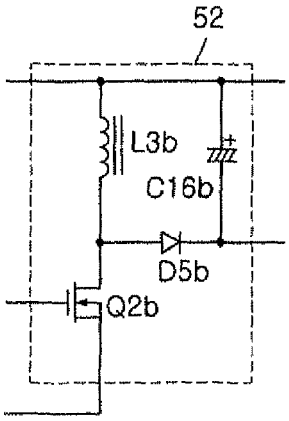

Further, a step-up/down chopper circuit 52 shown in FIG. 5B may be employed instead. The step-up/down chopper circuit 52 includes a series circuit of an inductor L3*b*) and a switching element Q2*b*, and a series circuit of a diode D5*b* and a smoothing capacitor C16*b* connected in parallel to the inductor L3*b*.

Figure 5C:
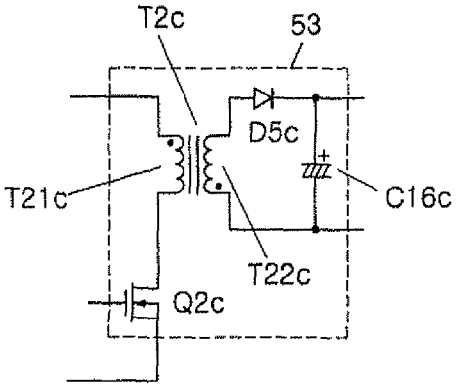

Further, a flyback converter circuit 53 shown in FIG. 5C may be employed instead. The flyback converter circuit 53 includes a switching element Q2*c* connected to a primary coil T21*c* of a transformer T2*c*, and a series circuit of a diode D5*c* and a smoothing capacitor C16*c* connected to both terminals of a secondary coil T22*c*. Further, the primary coil T21*c* and the secondary coil T22*c* of the transformer T2*c* have the same polarity.

Figure 5D:
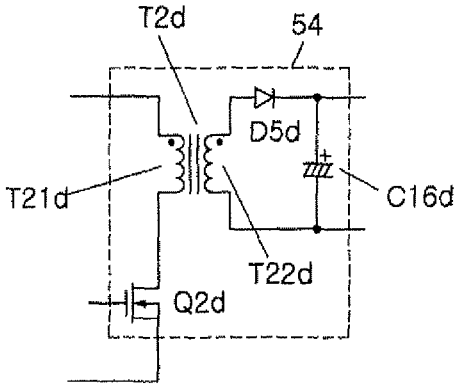

Further, a fly-forward converter circuit 54 shown in FIG. 5D may be employed instead. The fly-forward converter circuit 54 includes a switching element Q2*d* connected to a primary coil T21*d* of a transformer T2*d*, and a series circuit of a diode D5*d* and a smoothing capacitor C16*d* connected to both terminals of a secondary coil T22*d*. Further, the primary coil T21*d* and the secondary coil T22*d* of the transformer T2*d* have the opposite polarity.

Figure 5E:
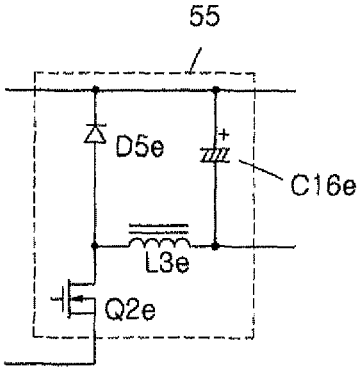

Further, as shown in FIG. 5E, a step-down converter circuit 55 having a switching element Q2*e* provided on a low side may be employed instead. The step-down converter circuit 55 includes a series circuit of a diode D5*e* and a switching element Q2*e*, and a series circuit of an inductor L3*e* and a smoothing capacitor C16*e* connected in parallel to the diode D5*e*.

Further, the circuit configuration of the step-up chopper circuit 4 of this embodiment includes, as shown in FIG. 2, the inductor L1, the switching element Q1, the diode D1 and the smoothing capacitor C5, but it is not limited thereto.

For example, the flyback converter circuit 53 shown in FIG. 5C may be employed thereto.

Further, in this embodiment, the LED elements 121 are used as semiconductor light emitting elements, but it is not limited thereto. For example, organic EL elements or semiconductor laser elements may be used as semiconductor light emitting elements.

Second Embodiment

Figure 6:
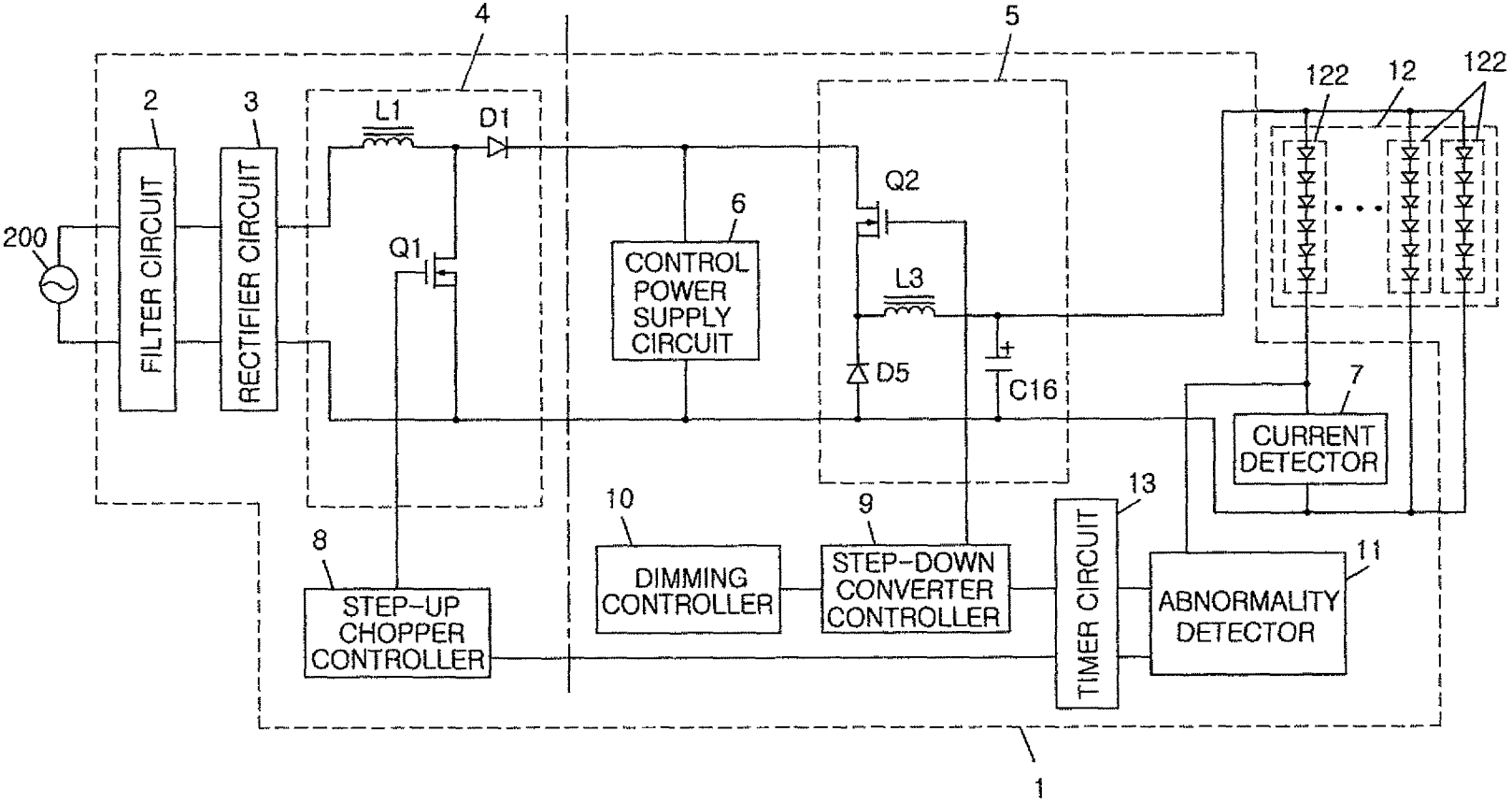
FIG. 6 illustrates a block diagram showing a configuration of a lighting device in accordance with a second embodiment of the present invention.

FIG. 6 illustrates a block diagram of the lighting device 1 in accordance with a second embodiment of the present invention. The lighting device 1 of this embodiment includes a timer circuit 13. The like reference numerals will be given to the like parts as those in the first embodiment, and redundant description thereof will be omitted. Further, in this embodiment, the filter circuit 2, the rectifier circuit 3, the step-up chopper circuit 4, the step-down converter 5, the control power supply circuit 6, the step-up chopper controller 8, the step-down converter controller 9, the dimming controller 10 and the timer circuit 13 correspond to a lighting unit described in the claims.

The timer circuit 13 alternately and repeatedly blocks and unblocks the output of the abnormality detector 11 when it is determined that the load 12 is in an abnormal state based on the output of the abnormality detector 11. For example, a case where the abnormality detector 11 is configured as shown in FIG. 3 and the collectors of the switching elements Q4 and Q5 are connected to the fourth pin P44 of the pulse width setting circuit IC4 will be described. In this case, when the abnormality detector 11 detects an abnormality in the load 12, the timer circuit 13 alternately and repeatedly blocks and unblocks electric conduction between the fourth pin P44 and the collectors of the switching elements Q4 and Q5.

If the timer circuit 13 allows electric conduction between the fourth pin P44 and the collectors of the switching elements Q4 and Q5, since the fourth pin P44 of the pulse width setting circuit IC4 is short-circuited to the circuit ground, the supply of the LED current Io is stopped. Further, if the timer circuit 13 blocks electric conduction between the fourth pin P44 and the collectors of the switching elements Q4 and Q5, the LED current Io in a normal state is supplied to the load 12 even though the load 12 is in an abnormal state.

That is, the timer circuit 13 performs an intermittent operation for intermittently reducing the LED current Io when it is determined that the load 12 is in an abnormal state based on the output of the abnormality detector 11. Accordingly, the LED current Io supplied to the load 12 is suppressed, and it is possible to prevent the concentrated current from flowing through the normally operating LED modules 122, and further to continuously turn on the normally operating LED modules 122.

Further, if the abnormality in the load 12 is eliminated and the load 12 returns to a normal state due to replacement or reinstallation of the LED modules 122 while the timer circuit 13 repeatedly performs the conduction blocking operation, the timer circuit 13 stops the conduction blocking operation. Accordingly, the LED current Io flowing in a normal state is supplied from the step-down converter 5 to the load 12, thereby normally turning on the load 12. That is, if the abnormality detector 11 is switched from a state in which an abnormality in the load 12 is detected to a state in which the abnormality in the load 12 is not detected while the timer circuit 13 performs an intermittent operation, the timer circuit 13 stops the intermittent operation. In this embodiment, when the abnormality in the load 12 is eliminated, the load 12 can be automatically restored to the ON state.

Further, a case where the collectors of the switching elements Q4 and Q5 are connected to the fourth pin P44 of the pulse width setting circuit IC4 has been described in this embodiment, but it is not limited thereto. In the similar way as the first embodiment, even when the collectors of the switching elements Q4 and Q5 are connected to the fifth pin P15 of the PFC circuit IC1, the same effect can be obtained.

Further, the collectors of the switching elements Q4 and Q5 may be connected to the non-inverting input terminal of the operational amplifier A2 of the dimming circuit IC5.

Further, the abnormality detector 11 may be configured as an abnormality detector 11*a* shown in FIG. 4.

Third Embodiment

Figure 7:
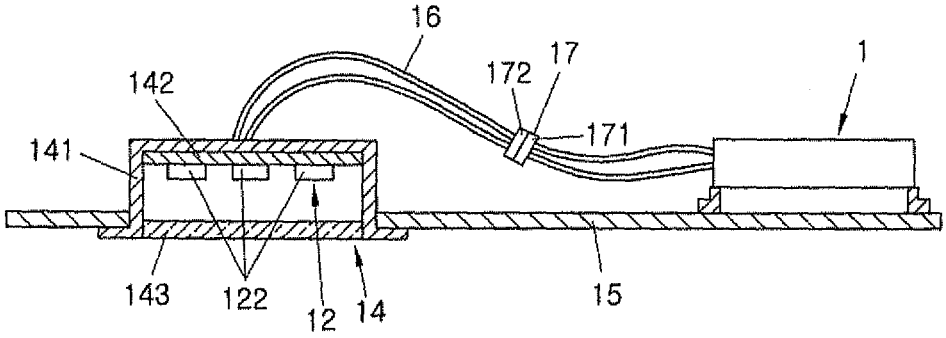
FIG. 7 schematically shows an illumination apparatus in accordance with a third embodiment of the present invention.

FIG. 7 illustrates an external appearance of an illumination apparatus in accordance with a third embodiment of the present invention. In this illumination apparatus, the lighting device 1 is separately provided from an LED unit 14.

The LED unit 14 is configured such that a substrate 142 in which the load 12 having a plurality of the LED modules 122 is mounted is contained in a metal cylindrical housing 141 having an open side, and the open side of the housing 141 is covered with a light diffusion plate 143. The light emitted from the LED modules 122 is irradiated to the outside after being diffused and transmitted through the light diffusion plate 143. The LED unit 14 is embedded in a ceiling panel 15 such that the light diffusion plate 143 is exposed downward from the surface of the ceiling panel 15.

The lighting device 1 is disposed on the rear surface of the ceiling panel 15. The step-down converter 5 is connected to the LED unit 14 through a lead line 16 and a connector 17 such that the LED current Io is supplied to the LED unit 14. The connector 17 is configured such that a connector 171 on the side of the lighting device 1 is detachably attachable to a connector 172 on the side of the LED unit 14. The lighting device 1 and the LED unit 14 can be separated from each other during maintenance or the like.

The lighting device 1 has a circuit configuration same as those of the first and second embodiments. Therefore, in the illumination apparatus described above, the LED current Io is reduced when an abnormality in the load 12 is detected in the LED unit 14.

Further, the lighting device 1 and the LED unit 14 may be contained in the same housing.

Further, the lighting device 1 may be used to turn on a backlight of an LCD monitor, a light source of a copying machine, scanner or projector or the like as well as being used in the illumination apparatus.

While the invention has been shown and described with respect to the embodiments, it will be understood by those skilled in the art that various changes and modification may be made without departing from the scope of the invention as defined in the following claims.

What is claimed is:

1. A lighting device comprising:

a lighting unit which controls a current being supplied to a load, in which light emitting modules, each having one or more semiconductor light emitting elements connected in series, are connected in parallel, to be a constant current;

a current detector which detects a current flowing through one of the light emitting modules; and an abnormality detector which compares a current value from the current detector with an upper current limit and a lower current limit of a predetermined current range to detect an abnormality in the load, wherein the abnormality detector detects the abnormality in the load if the detected value from the current detector is larger than the upper limit or smaller than the lower limit, and wherein if the abnormality detector detects the abnormality in the load, the lighting unit reduces the current being supplied to the load.

2. The lighting device of claim 1, wherein if the abnormality detector detects the abnormality in the load, the lighting unit performs an intermittent operation for intermittently reducing the current being supplied to the load, and if the abnormality detector is switched from a state in which the abnormality in the load is detected to a state in which the abnormality in the load is not detected while the lighting unit performs the intermittent operation, the lighting unit stops the intermittent operation.

3. The lighting device of claim 1, wherein as a difference between the upper limit of the predetermined current range and the detected value from the current detector that is larger than the upper limit, or a difference between the lower limit of the predetermined current range and the detected value from the current detector that is smaller than the lower limit increases, the lighting unit increases a reduction in the current being supplied to the load.

4. The lighting device of claim 1, wherein the lighting unit includes a direct current (DC) power supply for outputting a DC power and a constant current supply unit for controlling the current being supplied to the load to be a constant current by using the DC power supply as an input power supply.

5. The lighting device of claim 1, the current detector detects a current flowing through only said one of the light emitting modules.

6. An illumination apparatus comprising:

the lighting device described in claim 1; and the load described in claim 1, in which light emitting modules, each having one or more semiconductor light emitting elements connected in series, are connected in parallel, and to which a current is supplied from the lighting device.

7. The lighting device of claim 1, wherein the abnormality includes detachment of a light emitting module, an open-circuit mode failure or a short-circuit mode failure in a light emitting module.

* * * * *